US007408127B2

(12) United States Patent
Kim

(10) Patent No.: US 7,408,127 B2
(45) Date of Patent: Aug. 5, 2008

(54) KEYPAD STRUCTURE

(75) Inventor: Ki-Yeung Kim, Gumi-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/580,882

(22) Filed: Oct. 16, 2006

(65) Prior Publication Data

US 2007/0114118 A1 May 24, 2007

(30) Foreign Application Priority Data

Nov. 18, 2005 (KR) ..... 10-2005-0110760

(51) Int. Cl.
*H01H 9/00* (2006.01)

(52) U.S. Cl. ..... 200/314; 200/310

(58) Field of Classification Search ..... 200/314
See application file for complete search history.

(56) References Cited

U.S. PATENT DOCUMENTS 6,259,044 B1 * 7/2001 Paratore et al. ..... 200/5 A
6,824,321 B2 11/2004 Ward
6,956,561 B2 * 10/2005 Han ..... 345/170
7,053,799 B2 * 5/2006 Yu et al. ..... 341/31
7,090,368 B2 * 8/2006 Oross et al. ..... 362/84

FOREIGN PATENT DOCUMENTS

EP 1 197 835 A2 4/2002
JP 2004-125571 A 4/2004
KR 10-2003-0056494 4/2003
KR 10-2004-0001388 A 1/2004

* cited by examiner

*Primary Examiner*—Elvin Enad
*Assistant Examiner*—Lheiren Mae A Anglo
(74) *Attorney, Agent, or Firm*—Roylance, Abrams, Berdo & Goodman, LLP

(57) ABSTRACT

A key structure is disclosed in which the use of space for a keypad is maximized, thereby allowing free key inputs. The key structure includes a first keypad layer converted into a transparent state and a semi-transparent state, for displaying characters and numbers printed on the first keypad layer when the first keypad layer is in the semi-transparent state while displaying characters and numbers printed on a second keypad layer when the first keypad layer is in the transparent state. The key structure further includes the second keypad layer displaying characters and numbers printed on the second keypad layer by using light emitted from a light source when the first keypad layer is in the transparent state, and the light source emitting light to the second keypad layer when the first keypad layer is in the transparent state.

6 Claims, 3 Drawing Sheets

KEYPAD STRUCTURE

PRIORITY

This application claims the benefit under 35 U.S.C. § 119 (a) of Korean Patent Application No. 2005-110760, filed Nov. 18, 2005, in the Korean Intellectual Property Office, the entire contents of which are hereby incorporated by reference.

BACKGROUND OF THE INVENTION

1. Field of the Invention

The present invention relates to a keypad structure. More particularly, the present invention relates to a keypad structure which maximizes efficiency in use of space for a keypad, thereby allowing free key inputs.

2. Description of the Related Art

In conventional keypads, each key button includes characters, numbers and signs printed thereon. Further, when pressed, each key button transmits a signal corresponding to an input mode of the keypad.

However, in such a keypad, each key button is constrained to having the characters, numbers and signs printed thereon. Therefore, in a character mode, it is necessary for a user to input characters while simultaneously viewing the characters/numbers printed on the corresponding keys. Similarly, in a number mode, the user inputs numbers while viewing the characters/numbers printed on the corresponding keys. As a result, the keypad having the above-mentioned key structure limits rapid data input by a user.

SUMMARY OF THE INVENTION

The present invention has been made to address the above-mentioned and other problems occurring in the prior art. Accordingly, an object of the present invention is to provide a key structure in which a practical use of keypad space can be maximized, thereby helping a user to freely perform key inputs.

In order to achieve the above and other objects of the present invention, according to a first exemplary embodiment of the present invention, there is provided a key structure comprising a first keypad layer changeable into one of a transparent state and a semi-transparent state, the first keypad layer displaying characters and numbers printed on the first keypad layer when the first keypad layer is in the semi-transparent state. The key structure further comprises a second keypad layer for displaying characters and numbers printed on the second keypad layer when the first keypad layer is in the transparent state, and a light source for emitting light toward the second keypad layer when the first keypad layer is in the transparent state.

According to a second exemplary embodiment of the present invention, there is provided a key structure comprising a first keypad layer for displaying characters and numbers printed in a first color on the first keypad layer when an isolation portion is in a semi-transparent state, and a second keypad layer for displaying characters and numbers printed in a second color on the second keypad layer when the isolation portion is in a transparent state, the isolation portion being disposed between the first keypad layer and the second keypad layer, and converted into the transparent state or the semi-transparent state depending on electric signals. The key structure further comprising a light source for emitting the first colored light so as to cover the characters and numbers printed on the first keypad when the isolation portion is in the transparent state, wherein the first keypad covers the first colored characters and numbers printed on the first keypad by using the first colored light and displays the second colored characters and numbers printed on the second keypad layer.

According to a third exemplary embodiment of the present invention, there is a provided a key structure comprising a keypad layer for displaying first colored characters and numbers printed on the keypad layer when a light source emits light of a second color, while displaying characters and numbers of a second color printed on the keypad layer when the light source emits light in a first color, and the light source emitting the light of the first color so as to cover the first colored characters and numbers printed on the keypad layer, while emitting the light of the second color so as to cover the second colored characters and numbers printed on the keypad layer.

According to a fourth exemplary embodiment of the present invention, there is provided a key structure comprising a first keypad layer for displaying characters and numbers of a first color printed on the first keypad layer when a semi-isolation portion isolates a second keypad layer, and displaying characters and numbers of a second color printed on the second keypad layer while covering the characters and numbers of the first color printed on the first keypad layer with light of a first color emitted from a light source when the semi-isolation portion does not isolate the second keypad layer. The key structure further comprising the second keypad layer for displaying characters and numbers of a second color printed on the second keypad layer when the semi-isolation portion does not isolate the first keypad layer, the semi-isolation portion disposed between the first keypad layer and the second keypad layer, for isolating the first and second keypad layers when the light source does not emit the light, while failing to isolate the first and second keypad layers when the light source emits the light, and the light source for emitting the light so as to release the isolation of the semi-isolation portion, while emitting the light of the first color to cover the characters and numbers of the first color printed on the first keypad layer.

According to a fifth exemplary embodiment of the present invention, there is provided a key structure comprising a first keypad layer displaying characters and numbers of a first color printed on the first keypad layer when a light source does not emit light of a first color and a liquid contained in a second keypad layer comprising a third color, while displaying characters and numbers printed on a second keypad layer when the light source emits the light of the first color so as to cover the characters and numbers of the first color printed on the first keypad layer and the liquid of the third color contained in the second keypad layer is changed into liquid of a second color. The key structure further comprising the second keypad layer displaying characters and numbers printed on the second keypad layer when the light source emits the light of the first color so as to cover the characters and numbers of the first color printed on the first keypad layer and also the liquid of the third color contained in the second keypad layer is changed into the liquid of the second color, while covering the characters and numbers printed on the second keypad layer when the light source does not emit the light of the first color and the liquid of the second color contained in the second keypad layer is changed into the liquid of the third color. The key structure further comprising a first supplying portion for supplying ions to convert the liquid of the second color contained in the second keypad layer into the liquid of the third color, a second supplying portion for supplying ions to convert the liquid of third color contained in the second keypad layer into the liquid of the second color, and the light source emitting the light of the first color so as to cover the characters and numbers of the first color printed on the first keypad.

BRIEF DESCRIPTION OF THE DRAWINGS

The above and other objects, exemplary features, and advantages of the present invention will be more apparent from the following detailed description of exemplary embodiments taken in conjunction with the accompanying drawings, in which.

Throughout the drawings, like reference numbers should be understood to refer to like elements, features, and structures.

DETAILED DESCRIPTION OF EXEMPLARY EMBODIMENTS

The matters exemplified in this description are provided to assist in a comprehensive understanding of various exemplary embodiments of the present invention disclosed with reference to the accompanying figures. Accordingly, those of ordinary skill in the art will recognize that various changes and modifications of the exemplary embodiments described herein can be made without departing from the scope and spirit of the claimed invention. Descriptions of well-known functions and constructions are omitted for clarity and conciseness.

Figure 1:
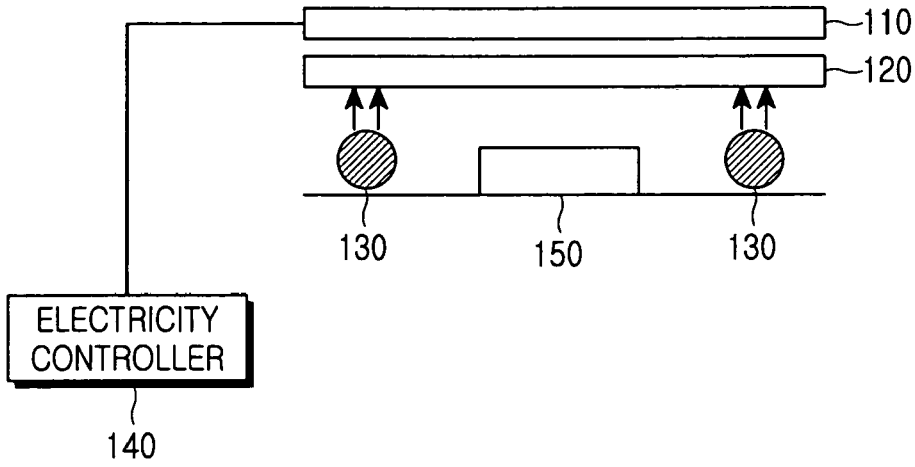
FIG. 1 is a sectional view of a key structure according to a first exemplary embodiment of the present invention.

FIG. 1 is a view of a key structure according to a first exemplary embodiment of the present invention.

The first exemplary embodiment of the present invention will be described on the assumption that numbers are printed on the first keypad layer and characters are printed on the second keypad layer.

Referring to FIG. 1, the key structure comprises the first keypad layer 110, the second keypad layer 120, a light source 130, an electricity controller 140, and a key input sensing portion 150.

The first keypad layer 110 is made of transparent/semi-transparent material, on which numbers are printed. The first keypad layer 110 can be converted into a transparent or semi-transparent state depending on the electric signals supplied from the electricity controller 140. If the electric signals are not supplied by means of the electricity controller 140, the first keypad layer 110 becomes semi-transparent and simultaneously the numbers printed on the first keypad layer 110 are displayed. Then, when the electricity controller 140 supplies the electric signals, the first keypad layer 110 is converted into a transparent state. At that time, when the first keypad layer 110 becomes transparent, the light source 130 located below a lower surface of the second keypad layer 120 emits light so that the characters printed on the second keypad layer 120 are displayed through the first keypad layer 110 in the transparent state.

The second keypad layer 120 is made of transparent material and located below a lower surface of the first keypad layer 110, on which the characters are printed. When the first keypad layer 120 receives electric signals from the electric controller 140 so as to become transparent and the light source 130 emits light, the characters printed on the second keypad layer 120 are displayed on the first keypad layer 110 in the transparent state.

The light source 130 is located below the lower surface of the second keypad layer 120. In order to display the characters printed on the second keypad layer 120, the light source 130 emits light to the second keypad layer 120 when the first keypad layer 110 becomes transparent,.

The electricity controller 140 cuts the supply of electric signals to the first keypad layer 110 so that the first keypad layer 110 becomes semi-transparent when it is intended that the numbers printed on the first keypad layer 110 are to be displayed. On the other hand, the electricity controller 140 supplies electric signals to the first keypad layer 110 so as to make the second keypad layer 120 transparent when it is intended that the characters printed on the second keypad layer 120 are to be displayed.

The key input sensing portion 150 senses key inputs through the first keypad layer 110 when the first keypad layer 110 displays the numbers printed thereon in the semi-transparent state. When the first keypad layer 110 is in the transparent state, the key input sensing portion 150 senses key inputs through the second keypad layer 120 displaying the characters.

Hereinafter, the operation of inputting characters and numbers through the key structure constructed as shown in the exemplary embodiment of FIG. 1 will be described. When a number input mode is selected from character/number input modes, a controller (not shown) of a portable terminal having character/number keys senses the selection of the number input mode and allows the electricity controller 140 to terminate the supply of the electric signals to the first keypad layer 110, so that the first keypad layer 110 becomes semi-transparent. The first keypad layer 110 in the semi-transparent state displays the numbers printed on the first keypad layer 110. When number keys are inputted, the controller senses the key inputs corresponding to the number keys through the key input sensing portion 150 and controls a display unit (not shown) to display the numbers corresponding to the number keys.

When a character input mode is selected from the character/number modes, the controller senses the selection of the character input mode and allows the electricity controller 140 to supply the electric signals to the first keypad layer 110, so that the first keypad layer 110 becomes transparent. Simultaneously, the controller enables the light source 130 to emit light so that the characters printed on the second keypad layer 120 are displayed through the first keypad layer 110 in the transparent state. When character keys are inputted, the controller senses the key inputs corresponding to the character keys through the key input sensing portion and controls the display unit to display the corresponding characters.

Figure 2:
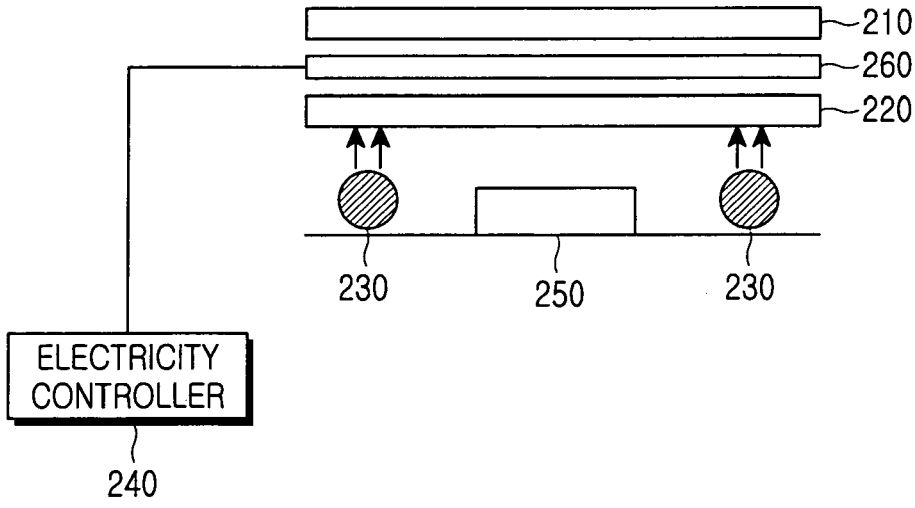
FIG. 2 is a sectional view of a key structure according to a second exemplary embodiment of the present invention.

FIG. 2 is a view of a key structure according to a second exemplary embodiment of the present invention.

Hereinafter, the key structure of the second exemplary embodiment of the present invention will be described on the assumption that a first keypad layer has numbers printed in a red color thereon, and a second keypad layer has characters printed in a blue color thereon.

Referring to FIG. 2, the key structure comprises the first keypad layer 210, the second keypad layer 220, an isolation portion 260, light sources 230, an electricity controller 240, and a key input sensing portion 250.

The first keypad layer 210 is made of transparent material, on which red numbers are printed. When the isolation portion

260 is in a semi-transparent state, the first keypad layer 210 displays the red numbers printed thereon. Further, when the isolation portion 260 is in a transparent state, the red numbers printed on the first keypad layer 210 are covered by red light emitted from the light sources 230. Simultaneously, the blue characters printed on the second keypad layer 220 are displayed through the first keypad layer 210 in the transparent state.

The second keypad layer 220 is made of transparent material and located below a lower surface of the first keypad layer 210, on which the characters are printed in blue color. When the isolation portion 260 is in a transparent state, the red light emitted from the light sources 230 covers the red numbers printed on the first keypad layer 210 and simultaneously the blue characters printed on the second keypad layer 220 are displayed through the first keypad layer 210 in the transparent state.

The isolation portion 260 is disposed between the lower surface of the first keypad layer 210 and an upper surface of the second keypad layer 220. Further, the isolation portion 260 becomes semi-transparent when the electricity controller 240 does not supply electric signals to the isolation portion 260, while becoming transparent when the electricity controller 240 supplies electric signals to the isolation portion 260.

The light sources 230 are located below the lower surface of the second keypad layer 220. When the isolation portion 260 becomes transparent, the light sources 230 emit colored light identical to the color of the numbers printed on the first keypad layer 210, for example, red light, and thus covers the numbers printed on the first keypad layer 210 in order to display the characters printed on the second keypad layer 220.

The electricity controller 240 terminates the supply of the electric signals to the isolation portion 260 so as to make the isolation portion 260 become semi-transparent, thereby displaying the numbers printed on the first keypad layer 210. Further, the electricity controller 240 supplies electric signals to the isolation portion 260 so as to make the isolation portion 260 become transparent so that the characters printed on the second keypad layer 220 are displayed.

The key input sensing portion 250 senses the key inputs of the first keypad layer 210 displaying the red numbers printed on the first keypad layer 210 when the isolation portion 260 becomes semi-transparent. Further, the key input sensing portion 250 senses the key inputs of the second keypad layer 210 displaying the blue characters printed on the second keypad layer 210 when the isolation portion 260 becomes transparent.

Hereinafter, the operation of inputting characters/numbers through the key structure constructed as shown in FIG. 2 will be described. When a number input mode is selected from character and number input modes, a controller of a portable terminal having the keys senses the selection of the number input mode and allows the electricity controller 240 to terminate the supply of electric signals to the isolation portion 260 so as to make the isolation portion 260 semi-transparent. When the isolation portion 260 becomes semi-transparent, the first keypad layer 210 displays the red numbers printed thereon. When the number keys are inputted, the controller senses the key inputs through the key input sensing portion 250 and enables a display unit (not shown) to display the numbers corresponding to the key inputs.

On the other hand, when a character input mode is selected from the character and number input modes, the controller senses the selection of the character input mode and enables the electricity controller 240 to supply the electric signals to the isolation portion 260 so as to make the isolation portion 260 transparent. When the isolation portion 260 becomes transparent, the controller controls the light sources 230 to emit red light so that the red light covers the numbers printed on the first keypad layer. Therefore, the blue characters printed on the second keypad layer 220 are displayed through the isolation portion 260 in the transparent state and the first keypad layer 210 made of the transparent material. When the character keys are inputted, the controller senses the key inputs through the key input sensing portion 250 and allows the display unit to display the characters corresponding to the key inputs.

Figure 3:
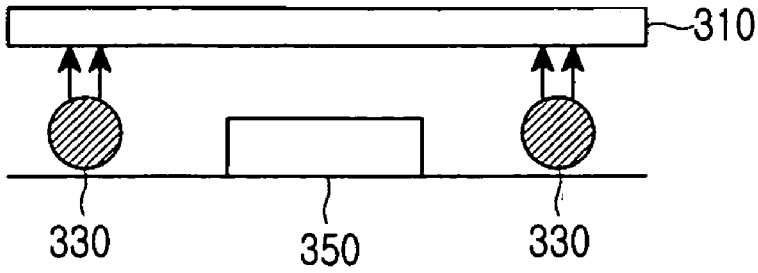
FIG. 3 is a sectional view of a key structure according to a third exemplary embodiment of the present invention.

FIG. 3 is a view of a key structure according to a third exemplary embodiment of the present invention.

The key structure of the third exemplary embodiment of the present invention will be described on the assumption that a keypad layer has numbers printed in red color thereon and characters printed in blue color thereon.

Referring to FIG. 3, the key structure comprises a keypad layer 310, light sources 330, and a key input sensing portion 350.

The keypad layer 310 is made of transparent material, on which numbers and characters are printed in red and blue respectively. When the light sources 330 emit blue light to the keypad layer 310, the blue light covers the blue characters printed on the keypad layer 310 so that the red numbers printed on the keypad layer 310 are displayed. Further, when the light sources emit red light to the keypad layer 310, the red light covers the red numbers printed on the keypad layer 310.

The key input sensing portion 350 senses the key input of the keypad layer 310 displaying the numbers printed in red on the keypad layer 310. Further, the key input sensing portion 350 senses the key input of the keypad layer 310 displaying the characters printed in blue on the keypad layer 310.

The operation of inputting characters and numbers through the key structure constructed as shown in FIG. 3 will be described. When the number input mode is selected from the character/number input modes, a controller (not shown) of a portable terminal including the keys senses the selection of the number input mode and controls the light source 330 to emit blue light. The blue light emitted from the light source 330 covers the characters printed in blue on the keypad layer 310 and enables the keypad layer 310 to display only the numbers printed in red thereon. When keys displaying numbers are inputted, the controller senses the key inputs through the key input sensing portion 350 and controls the display unit (not shown) to display the numbers.

When the character input mode is selected during input of the numbers, the controller senses the input of the characters and controls the light source 330 to emit the red light. The red light emitted from the light source 330 covers the numbers printed in red on the keypad layer 310 and enables the keypad layer 310 to display only the characters printed in blue on the keypad layer 310. When the character keys are inputted, the controller senses the key inputs through the key input sensing portion 350 and controls the display unit (not shown) to display the characters.

Figure 4:
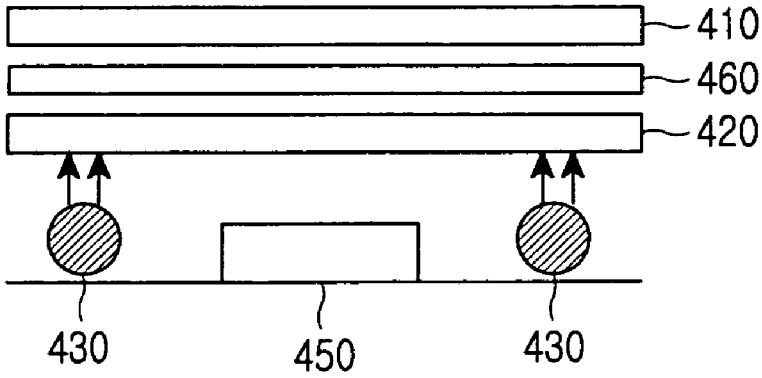
FIG. 4 is a sectional view of a key structure according to a fourth exemplary embodiment of the present invention.

FIG. 4 is a key structure according to a fourth exemplary embodiment of the present invention.

The key structure according to the fourth exemplary embodiment of the present invention will be described on the assumption that numbers are printed in red on the first keypad layer while characters are printed in blue on the second keypad layer.

Referring to FIG. 4, the key structure comprises a first keypad layer 410, a second keypad layer 420, a semi-isolation portion 460, a light source 430, and a key input sensing portion 450.

The first keypad layer 410 comprises a transparent material on which numbers are printed in red. When the second keypad layer 420 is shielded by the semi-isolation portion 460, the first keypad layer 410 displays the numbers printed in red thereon. Further, when the semi-isolation portion 460 does not shield the second keypad layer 420 and the light source 430 emits red light so as to cover the numbers printed in red on the first keypad layer 410, the characters printed in blue on the second keypad layer 420 are displayed through the first keypad layer 410.

The second keypad layer 420 comprises a transparent material and is located on a lower surface of the first keypad layer 410, on which the numbers are printed in blue. If the semi-isolation portion 460 does not intercept the first keypad layer and the light source 430 emits red light so as to cover the numbers printed in red on the first keypad layer 410, the characters printed in blue on the second keypad layer 420 are displayed through the first keypad layer 410 which is transparent.

The semi-isolation portion 460 is located between a lower surface of the first keypad layer 410 and an upper surface of the second keypad layer 420, which is made of a filter material treated with a reflection film having a transmittance of 50%. When the light source 430 does not emit light, the semi-isolation portion 460 isolates the first keypad layer 410 from the second keypad layer 420. When the light source 430 does emit light, the semi-isolation portion 460 releases the isolation between the first keypad layer 410 and the second keypad layer 420.

The light source 430 is located below the lower surface of the second keypad layer 420. When the red numbers printed on the first keypad layer 410 are displayed, the light source 430 does not emit light. However, when the blue characters printed on the second keypad layer 420 are printed on the second keypad layer 420, the light source emits light.

When the semi-isolation portion 460 isolates the first keypad layer 410 from the second keypad layer 420, the key input sensing portion 450 senses the key inputs of the first keypad layer 410 displaying the numbers printed in red on the first keypad layer 410. Further, when the semi-isolation portion 460 releases the isolation between the first keypad layer 410 and the second keypad layer 420, the key input sensing portion 450 senses the key inputs of the second keypad layer 420 displaying the characters printed in blue. The key structure as shown in FIG. 4 uses a principle in which a glass has a mirror effect of reflecting light in view from a bright side to a dark side while having no mirror effect when the light is emitted from the dark side.

The operation of inputting the characters/numbers through the key structure as shown in FIG. 4 will now be described. When the number input mode is selected from the character/number input modes, a controller (not shown) of a portable terminal including the keys senses the selection of the number input mode and controls the light source 430 not to emit light so that the semi-isolation portion 460 isolates the first keypad layer 410 from the second keypad layer 420. The isolation operation of the semi-isolation portion 460 causes the first keypad layer 410 to display the numbers printed in red on the first keypad layer 410. When the keys displaying the numbers respectively are inputted, the controller senses the key inputs through the key input sensing portion 450 and controls a display unit (not shown) to display the numbers corresponding to the key inputs.

When the character input mode is selected during number input, the controller senses the selection of the character input mode and enables the light source 430 to emit light so that the semi-isolation portion 460 releases the isolation between the first keypad layer 410 and the second keypad layer 420. When the isolation operation of the semi-isolation portion 460 is released, the controller controls the light source 430 to emit red light so that the red light covers the numbers printed in red on the first keypad layer 410. Therefore, the characters printed in blue on the second keypad layer 420 are displayed through the first keypad layer 410 which is made of a transparent material. When the keys displaying the characters respectively are inputted, the controller senses the key inputs through the key input sensing portion 450 and controls a display unit (not shown) to display the characters.

Figure 5:
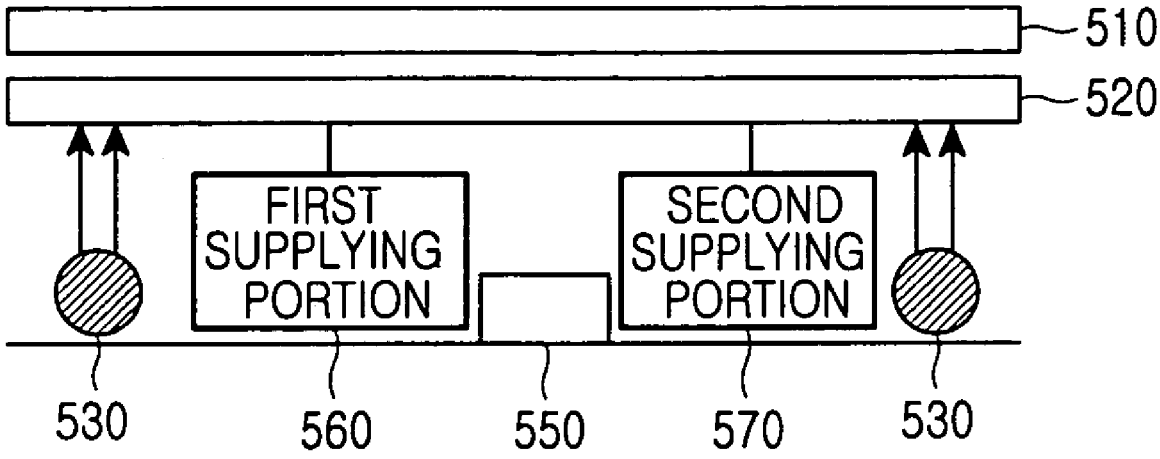
FIG. 5 is a sectional view of a key structure according to a fifth exemplary embodiment of the present invention.

FIG. 5 is a key structure according to a fifth exemplary embodiment of the present invention.

The key structure according to the fifth exemplary embodiment of the present invention will be described on the assumption that characters are printed in blue on a first keypad layer and numbers are printed in red on a second keypad layer. Further, in the fifth exemplary embodiment of the present invention, it is assumed that a third color of the second keypad layer is achromatic and the third color included in the second keypad layer is mixed with ions supplied from the second supplying portion and changed into the second color so as to be red.

Referring to FIG. 5, the key structure comprises a first keypad layer 510, a second keypad layer 520, a first supplying portion 560, a second supplying portion 570, a light source 530, and a key input sensing portion 550.

The first keypad layer 510 comprises a transparent material on which characters are printed in blue. If a liquid included in the second keypad layer 520 is achromatic and the light source 530 does not emit blue light, the first keypad layer 510 displays characters printed in blue. When the achromatic liquid included in the second keypad layer 520 is changed into a red liquid and the light source 530 emits blue light, the first keypad layer 510 displays numbers printed on the second keypad layer 520 displaying the fourth color. The fourth color can be obtained by mixing the blue color, which is the color of the numbers printed on the first keypad layer, with the red color, which is the color of the liquid included in the second keypad layer 520.

The second keypad layer 520 is formed of tubes which contain liquid and on which numbers are printed. The liquid is an indicator, that is, an achromatic phenolphthalein. When the liquid of the second keypad layer 520 is mixed with a small amount of ions supplied from the second supplying portion 570, the achromatic liquid is changed into a red liquid. Simultaneously, when the light source 530 emits blue light so as to cover the characters printed in blue on the first keypad layer 510, the numbers printed on the second keypad layer 520 are displayed in the fourth color. The fourth color can be obtained by mixing the blue color, which is the color of the characters printed on the first keypad layer, with the red color, which is the color of the liquid included in the second keypad layer 520.

When the red liquid of the second keypad layer 520 is mixed with a small amount of ions supplied from the first supplying portion 560, the red liquid is changed again into the achromatic liquid. Simultaneously, if the light source 530 does not emit blue light, the first keypad layer 510 displays the characters printed in blue on the first keypad layer 510.

The first supplying portion 560 supplies ions to enable the red liquid included in the second keypad layer 520 to change into the achromatic liquid. The ions of the first supplying portion 560 can be acid hydrogen ions.

The second supplying portion 570 supplies ions to enable the achromatic liquid included in the second keypad layer 520 to change into the red liquid. The ions of the second supplying portion 570 can be basic hydroxide ions.

The light source 530 is located below a lower surface of the second keypad layer 520. The light source 530 emits light when the blue characters printed on the first keypad layer 510 are displayed. However, the light source emits the blue light when the characters printed on the second keypad layer 520 are displayed.

If the light source 530 does not emit blue light and the liquid included in the second keypad layer 520 is achromatic, the key input sensing portion 550 senses key inputs of the first keypad layer 410 displaying the characters printed in blue. If the light source 530 emits blue color and the liquid included in the second keypad layer 520 is a red liquid, the key input sensing portion 550 senses the key inputs of the second keypad layer 520 displaying the numbers in a mixed color of blue and red.

The operation of inputting characters and numbers through the key structure constructed as shown in the exemplary embodiment of FIG. 5 will be described. When a character input mode is selected from character and number input modes, a controller (not shown) controls the light source 530 not to emit blue light so as to allow the liquid included in the second keypad layer 520 to be achromatic. Thus, the first keypad layer 510 displays the characters printed in blue thereon. When the character keys displaying the characters are inputted, the controller senses the key inputs of the first keypad layer 510 and controls a display unit (not shown) to display the characters corresponding to the key inputs.

When a number input mode is selected during input of the numbers, the controller senses the selection of the number input mode and enables the light source 530 to emit blue light so as to cover the characters printed in blue on the first keypad layer 510. Then, when the controller controls the second supplying portion 570 to supply a small amount of ions to the second keypad layer 520, the achromatic liquid included in the second keypad layer is mixed with ions supplied from the second supplying portion 570 and changed into red liquid. Therefore, the numbers printed in the fourth color on the second keypad layer are displayed through the first keypad layer 510, which is made of transparent material. The fourth color is a mixed color of blue, which is a color of the characters printed on the first keypad layer, and red, which is a color of the numbers printed on the second keypad layer. When the keys displaying the numbers are inputted, the controller senses the key inputs of the second keypad layer 520 through the key input sensing portion 450 and controls a display unit (not shown) to display the numbers corresponding to the key inputs.

When the character input mode is selected again, the controller controls the light source 530 not to emit light and enables the first supplying portion 560 to supply a small amount of ions to the second keypad layer 520. Therefore, the red liquid included in the second keypad layer is mixed with ions supplied to the first supplying portion 560 and changed into the achromatic liquid. As a result, the characters printed in blue on the first keypad layer are displayed.

As described above, exemplary embodiments of the present invention provide the key structure in which it is possible to maximize the practical use of space which the keypad occupies, thereby easily performing the input of signs such as various characters and numbers on the keypad layer occupying a defined space.

While the present invention has been particularly shown and described with reference to certain exemplary embodiments thereof, it will be understood by those of ordinary skill in the art that various changes in form and detail may be made therein without departing from the spirit and scope of the present invention as defined by the appended claims and equivalents thereof.

What is claimed is:

1. A key structure comprising:

a first keypad layer changeable into one of a transparent state and a semi-transparent state, a first keypad layer displaying at least one of a first character and number on the first keypad layer according to a facilitating state of transparent/semi-transparent;

a second keypad layer displaying at least one of a second character and number on the second keypad layer according to a facilitating state of transparent/semi-transparent in the first keypad layer;

a light source for emitting a light for displaying at least one of a second character and number printed on a second keypad layer;

a controller for facilitating a first keypad layer into a one of a transparent state and a semi-transparent state; and a key input sensor for sensing one of the first keypad layer and the second keypad layer.

2. A key structure comprising:

at least one of a keypad layer;

wherein the keypad layer comprises a first keypad layer and a second keypad layer;

wherein the first keypad layer is changeable into one of a transparent state and a semi-transparent state, the first keypad layer displaying at least one of a first character and number printed on the first keypad layer when the first keypad layer is in the semi-transparent state, and the first keypad layer displaying at least one of a second character and number printed on the second keypad layer when the first keypad layer is in the transparent state;

wherein the second keypad layer for displaying at least one of a second character and number printed on the second keypad layer when the first keypad layer is in the transparent state;

a light source for emitting light toward the second keypad layer when the first keypad layer is in the transparent state;

a controller for selectively applying electric signals to the first keypad layer to facilitate the transparent state of the first keypad, wherein the first keypad layer is in the semi-transparent state when the electric signal is not applied thereto; and a key input sensor for sensing at least one of a key input of the first keypad layer when the first keypad layer is in the semi-transparent state and a key input of the second keypad layer when the first keypad layer is in the transparent state.

3. The key structure as claimed in claim 2, wherein the second keypad layer is located below a lower surface of the first key pad layer.

4. The key structure as claimed in claim 2, further comprising:

the keypad layer for displaying at least one of a first character and number comprising a first color printed on the keypad layer when illuminated by a light of a second color, and displaying at least one of a character and number of a second color printed on the keypad layer when illuminated by a light of a first color, the light source of the first color covers the at least one of the first character and number printed on the keypad layer, and the light source of the second color covers the at least one of the second character and number printed on the keypad layer, wherein when a character and a number are respectively printed as at least two colors on at least one of the keypad layer.

5. The key structure as claimed in claim 4, further comprising a key input sensor for sensing at least one of a key input through the keypad layer displaying the at least one of the first character and number when illuminated by the light of the second color, and a key input through the keypad layer displaying the at least one of the second character and number of the second color when illuminated by the light of the first color.

6. The key structure as claimed in claim 4, wherein the keypad layer is transparent.

* * * * *